US008916251B2

(12) United States Patent
Tvelil

(10) Patent No.: US 8,916,251 B2
(45) Date of Patent: Dec. 23, 2014

(54) TOWEL

(76) Inventor: Neeta Tvelil, Chicago, IL (US)

( * ) Notice: Subject to any disclaimer, the term of this patent is extended or adjusted under 35 U.S.C. 154(b) by 353 days.

(21) Appl. No.: 13/237,308

(22) Filed: Sep. 20, 2011

(65) Prior Publication Data

US 2013/0071597 A1 Mar. 21, 2013

(51) Int. Cl.
*B32B 3/02* (2006.01)
*B32B 3/08* (2006.01)
*A47K 10/02* (2006.01)

(52) U.S. Cl.
CPC ..... *A47K 10/02* (2013.01)
USPC ..... 428/54; 428/44; 428/53

(58) Field of Classification Search
USPC ..... 428/54, 53, 44
See application file for complete search history.

(56) References Cited

U.S. PATENT DOCUMENTS

2012/0003419 A1* 1/2012 Xue ..... 428/100

* cited by examiner

*Primary Examiner* — Brent O'Hern
(74) *Attorney, Agent, or Firm* — Mark J. Nahnsen; Barnes & Thornburg LLP

(57) ABSTRACT

A towel having an elongated first body portion provided with a first width and extends in a generally vertical direction when used with a towel bar. The elongated first body portion includes a first end that is configured to be secured to the towel bar by use of an attachment member. The elongated first body portion also includes a second end that is coupled to a first drying portion, which has a second width that is greater than the first width of the elongated first body portion. The towel may also include a second body portion that extends over the towel bar and is positioned to lie generally parallel to the elongated first body portion.

6 Claims, 7 Drawing Sheets

TOWEL

BACKGROUND

The present disclosure relates to towels. More particularly, the present disclosure relates to towels used for personal use for drying ones hands and face after washing. Towels used for drying are not typically accessible by children when the towel is hanging on a towel bar mounted on the wall. Even if children can reach the towel, they typically tug at the towel, which causes the towel to become disconnected from the towel bar and end up on the floor creating an unsightly condition or possibly a hazard.

SUMMARY

According to the present disclosure, a towel is adapted to be used with a towel bar to permit a user to dry off their hands and face. The towel is made, at least in part, from an absorbent material that will absorb water as desired by the user.

In illustrative embodiments, the towel includes an elongated first body portion having a first width that extends in a generally vertical direction when used with the towel bar. The elongated first body portion includes a first end that is configured to be secured to the towel bar by use of an attachment portion. The elongated first body portion also includes a second end that is coupled to a first drying portion, which has a second width that is greater than the first width of the elongated first body portion. The first drying portion is made from an absorbent material, such as terrycloth, and can be configured into various decorative shapes.

In illustrative embodiments, the towel includes a second body portion that is positioned to lie generally parallel to the elongated first body portion. The second body portion includes a second drying portion that is configured to be positioned generally against the first drying portion when the towel is positioned over the towel bar.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
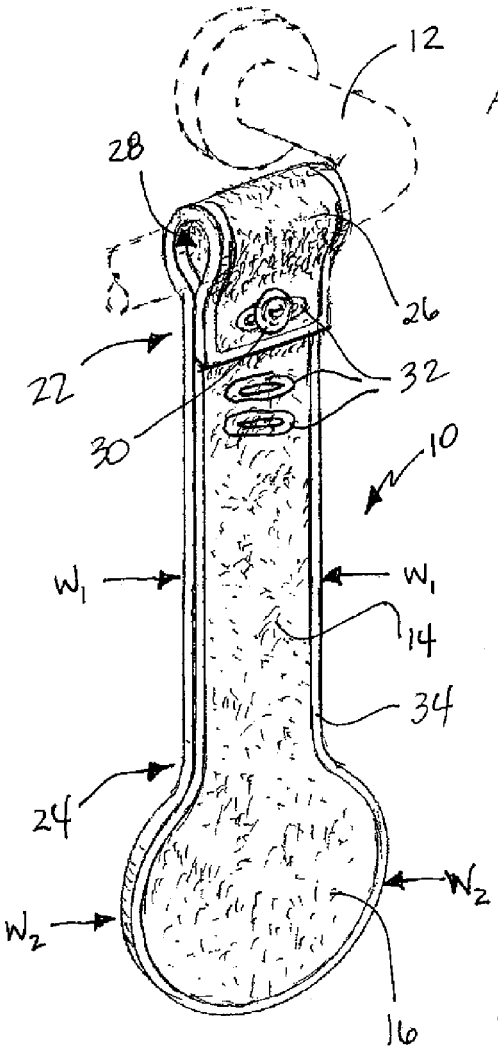
FIG. 1 is a perspective view of the towel coupled to a towel bar, and showing the elongated first body portion secured to the towel bar by use of a fastener such as a button, for example.

While the present disclosure may be susceptible to embodiment in different forms, there are shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

The present disclosure relates to a towel 10 for use with a towel bar 12 as shown, for example in FIG. 1. The towel 10 can include an elongated first body portion 14 and first drying portion 16, as shown in FIGS. 1-5 and can include a second body portion 18 and second drying portion 20, as shown in FIGS. 6-10. The towel 10 can also include a first drying portion 16 arranged in various shapes and designs, as shown in FIGS. 11-25.

Towel 10 includes a first body portion 14, as shown for example, in FIG. 1, having a first end 22 and a spaced apart second end 24. First body portion 14 has a width $W_1$. First end 22 of towel 10 is coupled to a towel attachment portion 26 and second end 24 is attached to first drying portion 16. Towel 10 is configured to be coupled to towel bar 12. First body portion 14 is preferably made from a cotton terrycloth material but can be made from other absorbent or non-absorbent materials. First body portion 14 may also include trim 34 that extends around the perimeter of towel 10. First body portion 14 includes a length from about sixteen inches to about thirty six inches to allow for the positioning of first drying portion 16 so that towel 10 can be best reached by children.

Figure 2:
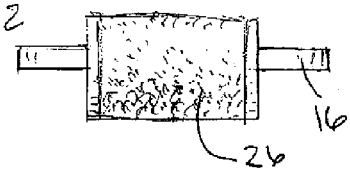
FIG. 2 is a top view of the towel.
Figure 3:
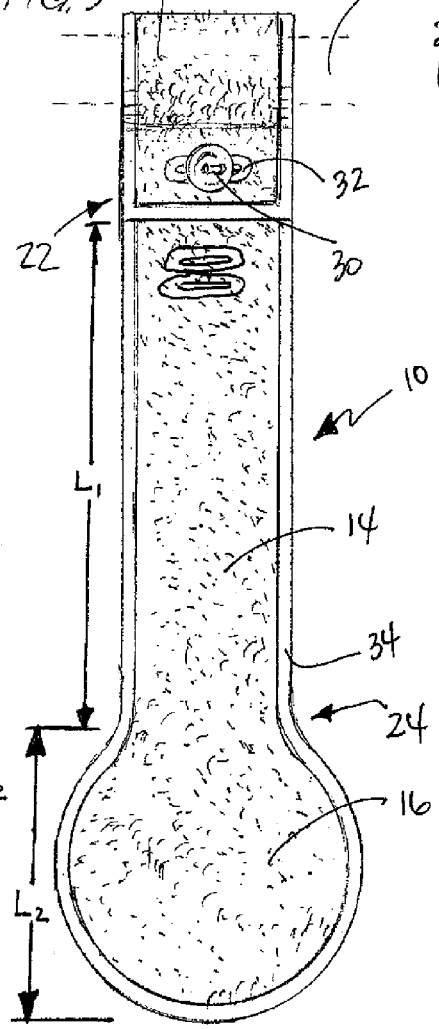
FIG. 3, is a front view of the towel coupled to a towel bar.
Figure 4:
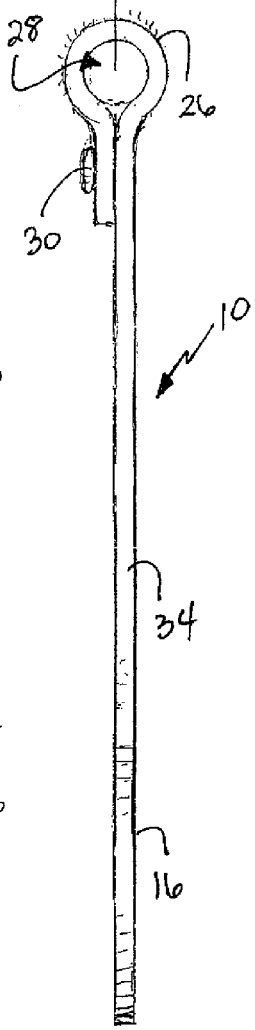
FIG. 4 is a side view of the towel.
Figure 5:
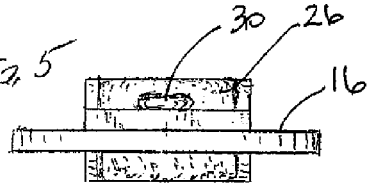
FIG. 5 is a bottom view of the towel.

Attachment portion 26 of towel 10 is coupled to first body portion 14 and is configured to be positioned over towel bar 12 to form a loop 28. Loop 28 is large enough to permit attachment portion 26 to slide along towel bar 12. Attachment portion 26 also includes a fastener. The fastener can be in the form of a button 30 and slot 32, as shown in FIGS. 1 and 2, or can be in the form of a Velcro type hook and loop fastener, a snap closure or other type of mechanical fastener, known by those of skill in the art. To use attachment portion 26, attachment portion 26 is positioned around towel bar 12 and button 30 is inserted into slot 32. Attachment portion 26 secures towel 10 to towel bar 12 to prevent unwanted removal. Towel 10 may include multiple slots 32 or velcro attachment points to allow the length of the towel 10 to be adjusted as shown in FIGS. 1 and 3.

First drying portion 16 of towel 10 is connected to second end 24 of first body portion 14 and is used to absorb moisture from a user's hands and face, as shown in FIG. 1, for example.

First drying portion 16 has a width $W_2$ which is 1.5 to 2 times wider that width $W_1$ of first body portion 14. First drying portion 16 is preferably made from a cotton terry cloth or other absorbent material.

Figure 15:
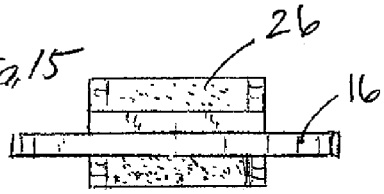
FIG. 15 is a bottom view of the towel of FIG. 11.
Figure 16:
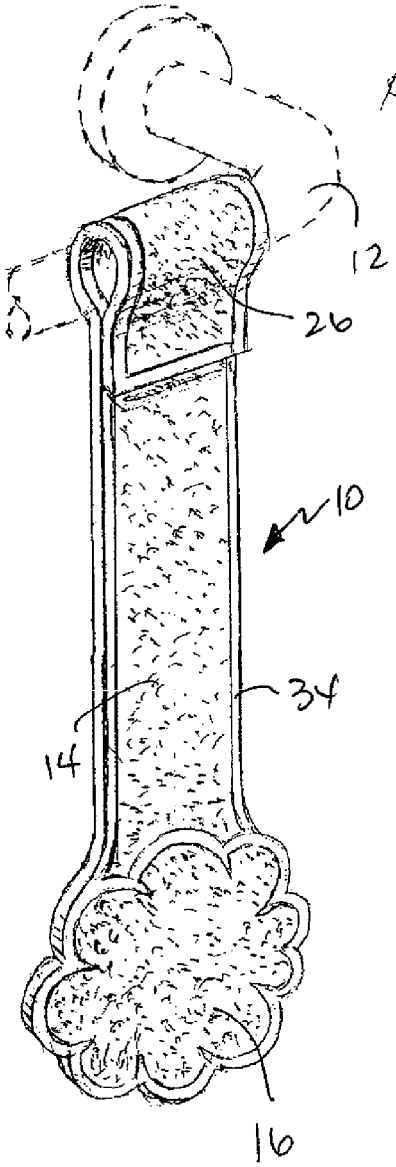
FIG. 16 is a perspective view of another embodiment of the towel showing the drying portion in the shape of a cloud.
Figure 17:
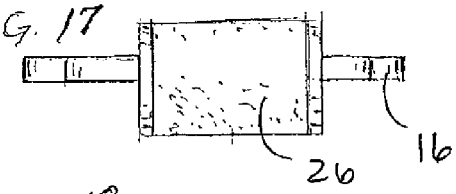
FIG. 17 is a top view of the towel of FIG. 16.
Figure 18:
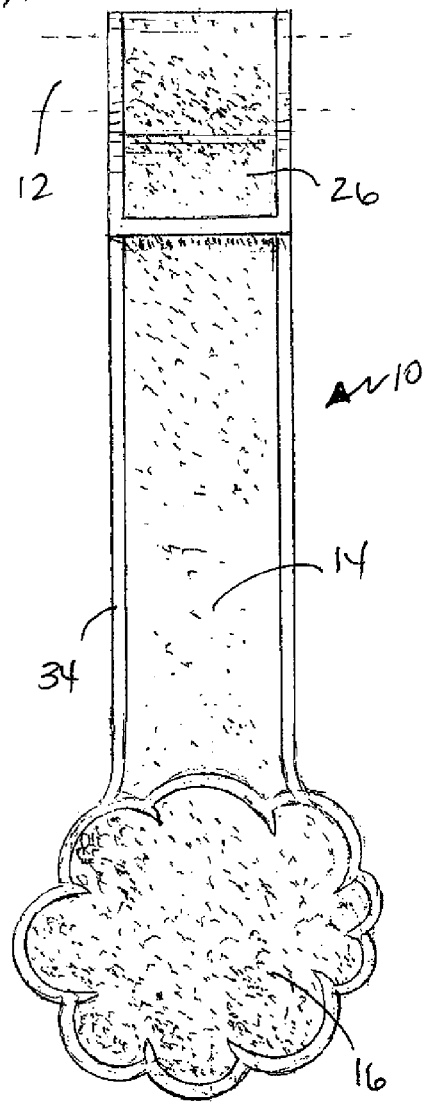
FIG. 18 is a front view of the towel of FIG. 16.
Figure 19:
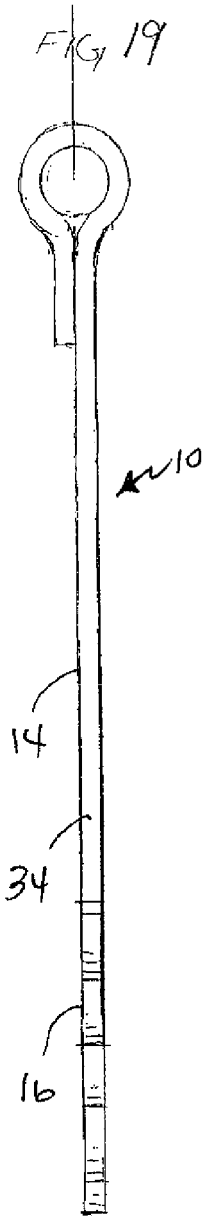
FIG. 19 is a side view of the towel of FIG. 16.
Figure 20:
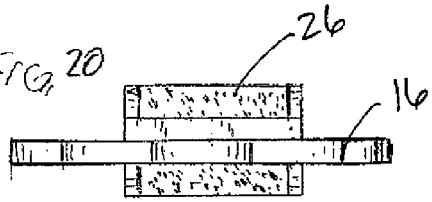
FIG. 20 is a bottom view of the towel of FIG. 16.
Figure 21:
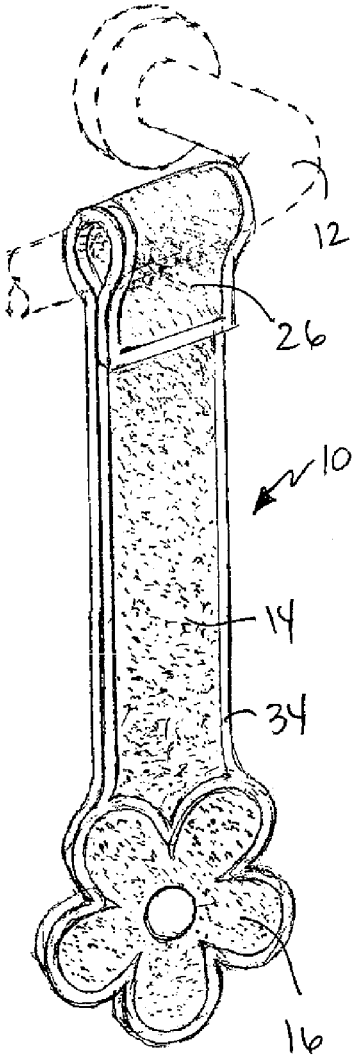
FIG. 21 is a perspective view of another embodiment of the towel showing the drying portion in the shape of a flower.
Figure 22:
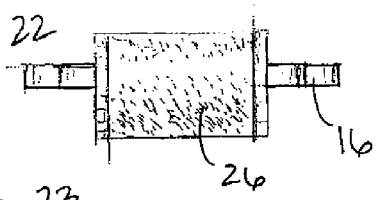
FIG. 22 is a top view of the towel of FIG. 21.
Figure 23:
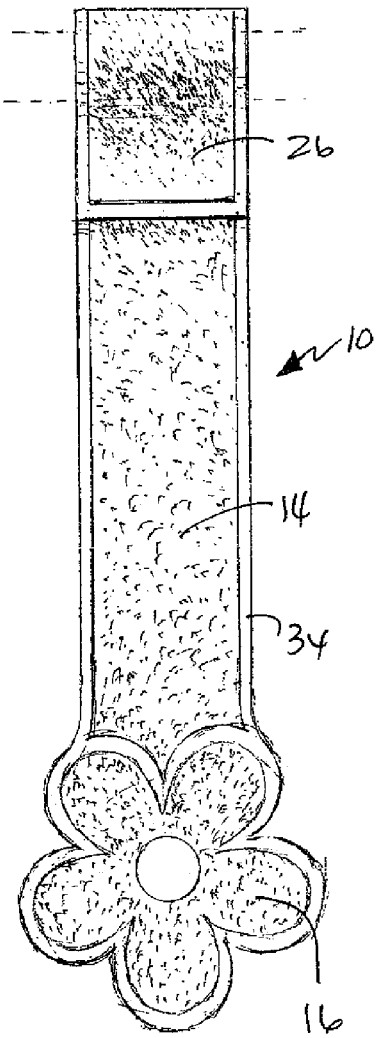
FIG. 23 is a front view of the towel of FIG. 21.
Figure 24:
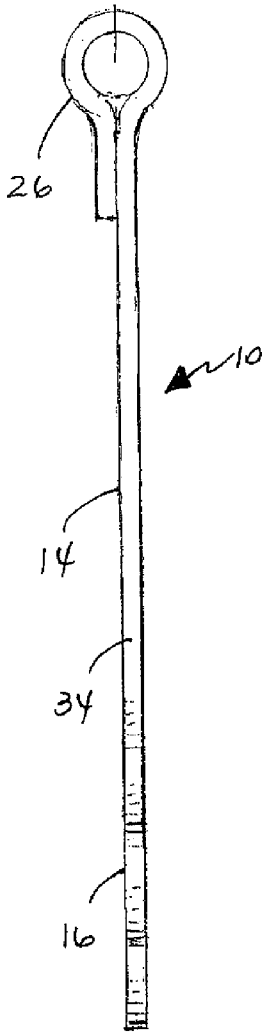
FIG. 24 is a side view of the towel of FIG. 21.
Figure 25:
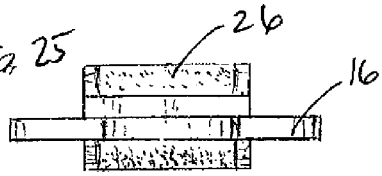
FIG. 25 is a bottom view of the towel of FIG. 21.

First drying portion 16 of towel 10 can be manufactured into various shapes including circles, as shown in FIG. 1, squares, rectangles, triangles, and can include various designs such as baseballs, as shown in FIGS. 11-15, clouds, as shown in FIGS. 16-20, and flowers, as shown in FIGS. 21-15, for example. First drying portion 16 may also include trim 34 that extends around the perimeter of first drying portion 16. As shown in the figures, first drying portion 16 can be circular, scalloped, petal or clover shaped to form various designs.

In another embodiment, towel 100 includes a first body portion 14 and a second body portion 36, as shown in FIGS. 6-10. When towel 100 is secured to towel bar 12, first body portion 14 is generally parallel to second body portion 36. Second body portion 36 also has a width of $W_1$, which is generally the same width of the first body portion 14. First body portion 14 is coupled to second body portion 36 by transition region 38. Transition region 38 is configured to be positioned over towel bar 12 when towel 100 is positioned on towel bar 12. Second body portion 36 is preferably made from an absorbent material, such as terrycloth but can also be made from a non-absorbent material. Second body portion 36 includes one or more fasteners 40 to secure second body portion 36 to first body portion 14. Fasteners 40 can be in the form of buttons, snaps, hook and loop or other fastener material known to those of skill in the art.

Figure 6:
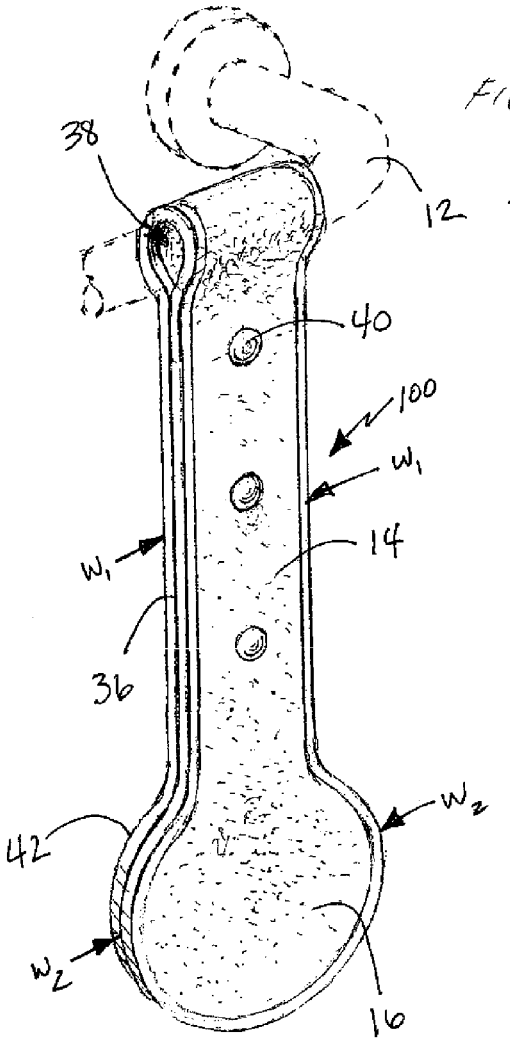
FIG. 6 is a perspective view of another embodiment of the towel showing the towel having first and second elongated body portions and first and second hand drying portions.
Figure 7:
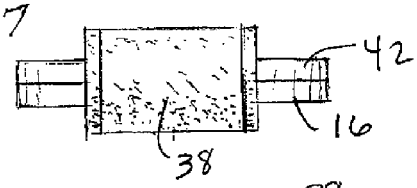
FIG. 7 is a top view of the towel of FIG. 6.
Figure 8:
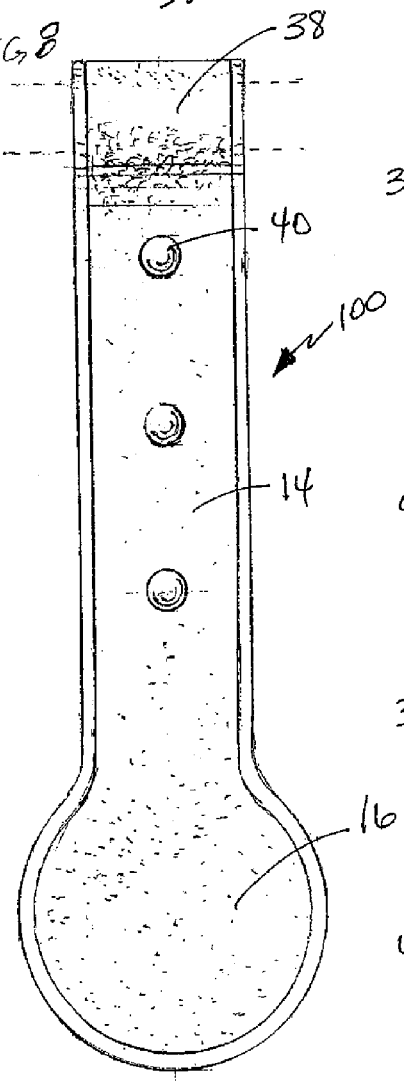
FIG. 8 is a front view of the towel of FIG. 6.
Figure 9:
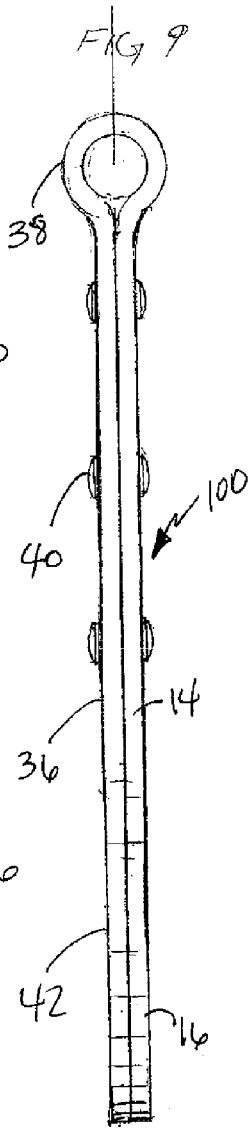
FIG. 9 is a side view of the towel of FIG. 6.
Figure 10:
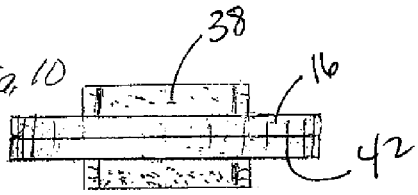
FIG. 10 is a bottom view of the towel of FIG. 6.
Figure 11:
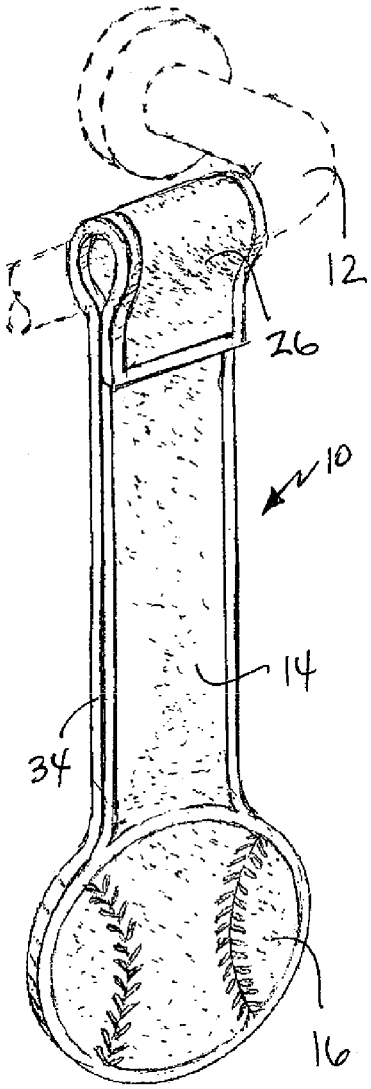
FIG. 11 is a perspective view of another embodiment of the towel showing the drying portion in the shape of a baseball.
Figure 12:
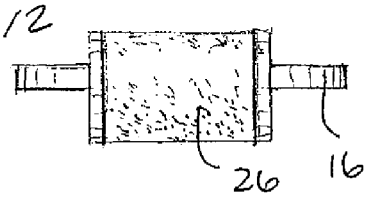
FIG. 12 is a top view of the towel of FIG. 11.
Figure 13:
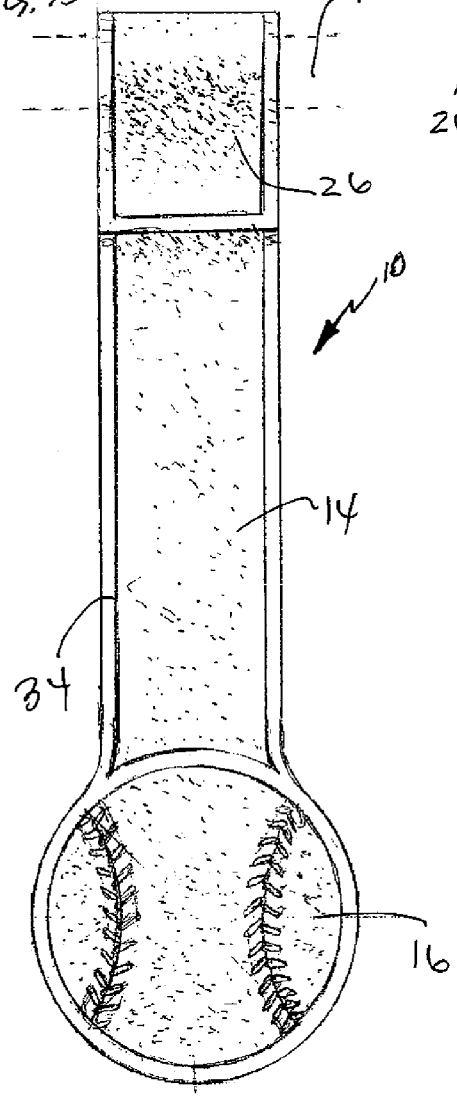
FIG. 13 is a front view of the towel of FIG. 11.
Figure 14:
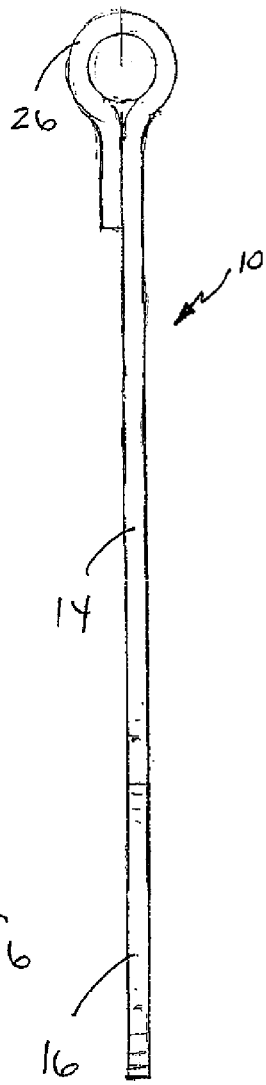
FIG. 14 is a side view of the towel of FIG. 11.

Second body portion 36 of towel 100 also includes a second drying portion 42, as shown in FIG. 6. Second drying portion 42 is configured to be oriented generally parallel to first drying portion 16 when towel 100 is properly secured to towel bar 12. Second drying portion 42 has a width $W_2$ that is approximately 1.5 to 3 times wider that width $W_1$ of second body portion 36. This arrangement permits more towels 100 to be placed on towel bar 12 at the same time. This arrangement also permits the use of towel 100 with standard bath towels on the same towel bar 12. Second drying portion 42 is preferably made from cotton terry cloth or other absorbent material.

Figure 26:
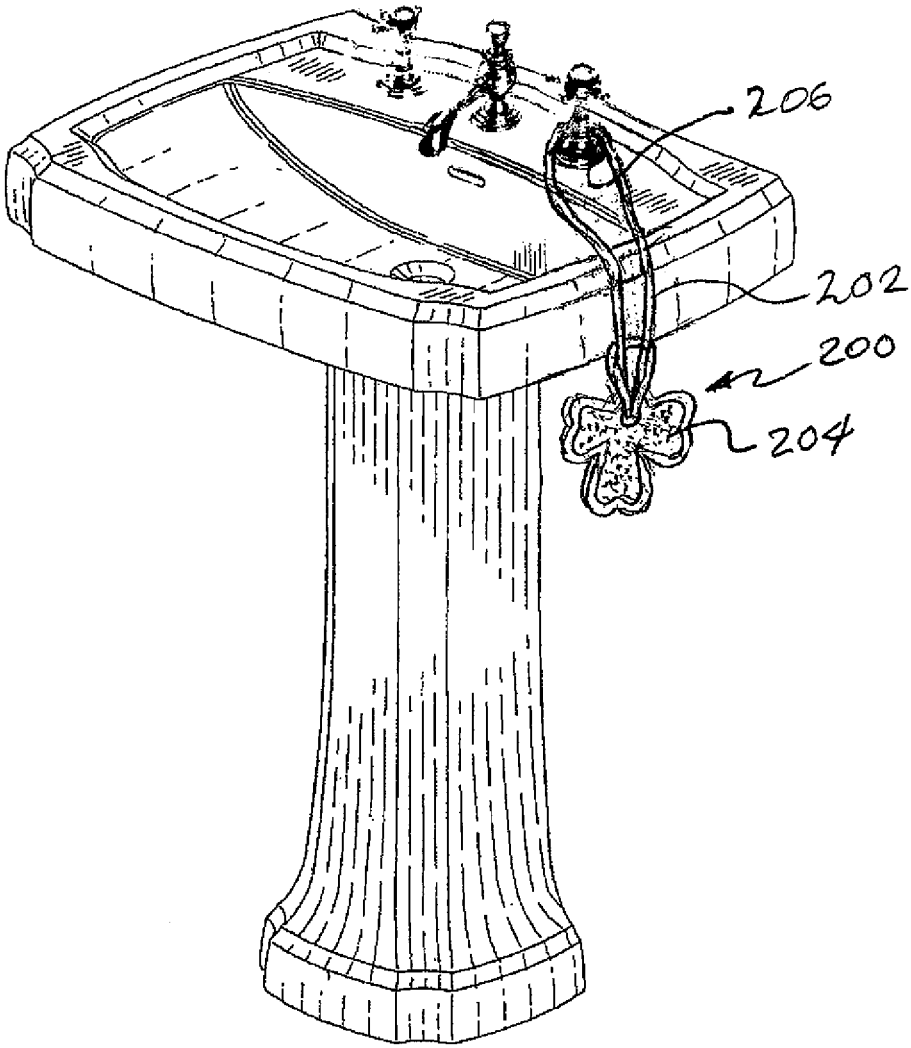
FIG. 26 is another embodiment of the towel showing the towel attached to a faucet.
Figure 27:
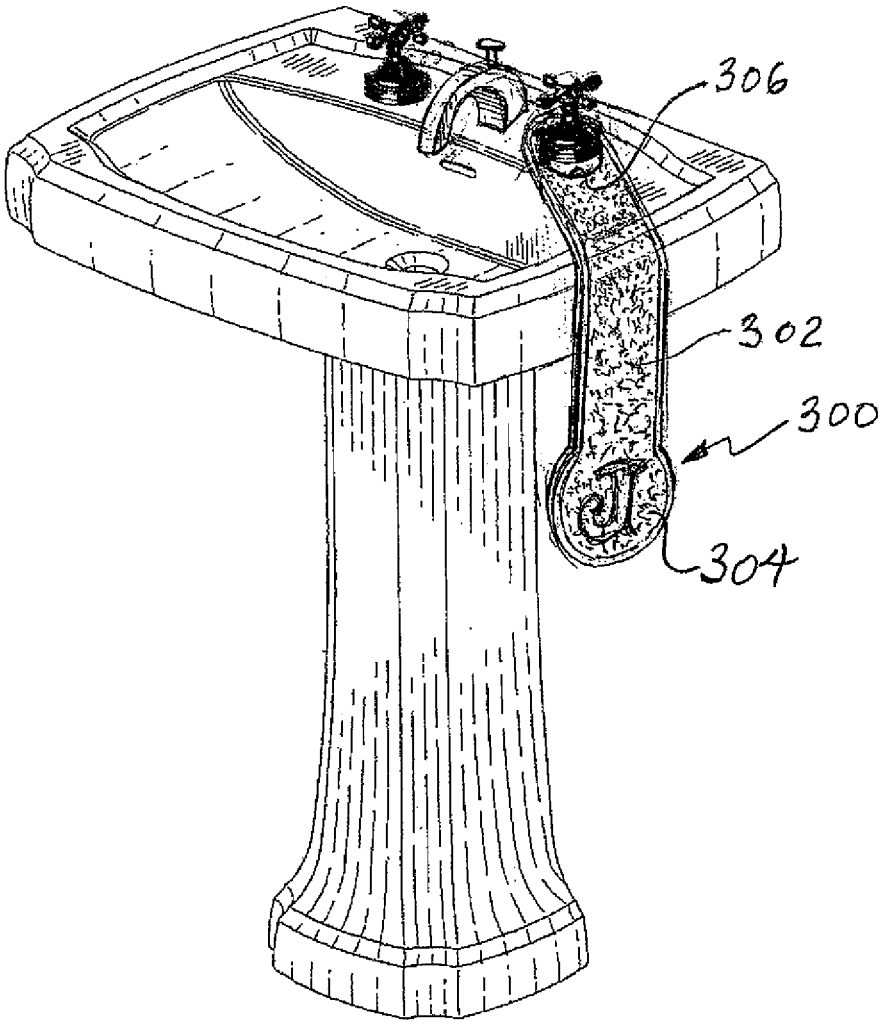
FIG. 27 is another embodiment of a towel attached to a faucet.

In another embodiment, towel 200 is configured to be coupled to a faucet handle, as shown, for example, in FIG. 26. Towel 200 includes a body portion 202 and a drying portion 204 coupled to the body portion 202. Towel 200 also includes an attachment portion 206 that is configured to be coupled to a faucet handle. Attachment portion 206 includes an opening and can include an elastic portion to allow the opening to be slipped over the faucet handle. Alternatively attachment portion 206 may include a fastener such a snap, button or hook and loop fasteners to secure the towel 200 to the faucet handle.

In use, a user takes towel 10 and positions attachment portion 26 around the rod of towel bar 12. Once attachment portion 26 is positioned around the rod of towel bar 12, button 30 is inserted through slot 32 to secure attachment portion 26 to the towel bar 12. Once attachment portion 26 is secured to towel bar 12, body portion 14 and drying portion 16 are permitted to naturally hang so that they are accessible for a user to dry their hands.

The towel 10 can be used with a towel bar having a body portion 14 provided with a first end and a spaced apart second end. The body portion 14 having a width $W_1$ and a length $L_1$. The towel 10 includes an attachment portion 26 attached to the first end of the body portion 14. The attachment portion 26 including at least one fastener and is configured to secure the towel 10 to the towel bar 12. The towel 10 also includes a drying portion 16 attached to the second end of the body portion 14. The drying portion 14 of towel 10 includes a width $W_2$ and a length $L_2$.

The drying portion 16 of towel 10 made from an absorbent material to absorb moisture from a users hands and face. The towel 10 is permitted to slide along the towel bar 12 and can be selectively attached and removed from the towel bar 12 by the user. The towel 10 includes the fastener which can be in the form of a button and slot to secure the towel 10 to the towel bar 12. The first drying portion 16 is preferably made from a terrycloth type material can be formed into an ornamental design, such as a flower, baseball or cloud, for example.

The width $W_2$ of the drying portion 16 of towel 10 is generally two times the width $W_1$ of the first body portion 14 but can be greater. The length $L_1$ of first body portion 14 is at least three times greater than the length $L_2$ of first drying portion 16 of towel 10.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the invention are desired to be protected. The applicants have provided description and figures which are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A towel for use with a towel bar comprising:

a body portion having a first end and a spaced apart second end the body portion having a width $W_1$ and a length $L_1$, the body portion have a first side edge and a spaced apart second side edge that is generally parallel to the first side edge;

an attachment portion attached to the first end of the body portion, the attachment portion having a width that is generally the same as the width of the body portion, the attachment portion including at least one fastener and configured to secure the towel to the towel bar;

a drying portion attached to the second end of the body portion, the drying portion having a width $W_2$ and a length $L_2$, the drying portion is in a shape selected from the group consisting of circular shaped, scalloped shaped, petal shaped, and clover shaped, the drying portion made from an absorbent material to absorb moisture from a users hands and face, and wherein the towel is permitted to slide along the towel bar and can be selectively attached and removed from the towel bar by the user.

2. The towel of claim 1 wherein the fastener is in the form of one or more buttons and slots to secure the towel to the towel bar.

3. The towel of claim 2, wherein the drying portion is formed into an ornamental design.

4. The towel of claim 1, wherein the width $W_2$ of the drying portion is generally two times the width $W_1$ of the body portion.

5. The towel of claim 4, wherein the length $L_1$ of body portion is at least three times greater than the length $L_2$ of drying portion.

6. The towel of claim 1, wherein the width $W_2$ of the drying portion is a least two times the width $W_1$ of the body portion.

* * * * *